United States Patent [19]

Wakimoto

[11] Patent Number: 4,858,083

[45] Date of Patent: Aug. 15, 1989

[54] COLOR CHANGEABLE PHOTO-DECORATIVE PENCIL TORCH

[76] Inventor: Yasuo Wakimoto, 3-6, Nishiasakusa 1-chome, Taito-Ku, Tokyo, Japan

[21] Appl. No.: 286,897

[22] Filed: Dec. 20, 1988

[30] Foreign Application Priority Data

Dec. 25, 1987 [JP] Japan ..... 62-198799

[51] Int. Cl.[4] ..... F21V 33/00

[52] U.S. Cl. ..... 362/101; 362/208; 362/806; 362/811

[58] Field of Search ..... 362/101, 208, 253, 293, 362/318, 806, 811; 40/409, 406

[56] References Cited

U.S. PATENT DOCUMENTS

| | | | |
|---|---|---|---|
| 3,531,635 | 9/1970 | Hancock | 362/101 |
| 4,070,777 | 1/1978 | Lo Giudice | 362/101 |
| 4,170,035 | 10/1979 | Walker | 362/806 X |

*Primary Examiner*—Stephen F. Husar

*Attorney, Agent, or Firm*—Kane, Dalsimer, Sullivan, Kurucz, Levy, Eisele and Richard

[57] ABSTRACT

A color changeable photo-decorative pencil torch which can be used not only for lighting but also as a toy. The pencil torch having liquid suspended light scattering members which when illuminated serve to scatter light in all directions. A movable multicolored filter is used to randomly vary the color of the light reflected by the light scattering members.

6 Claims, 4 Drawing Sheets

COLOR CHANGEABLE PHOTO-DECORATIVE PENCIL TORCH

BACKGROUND OF THE INVENTION

The present invention relates to a color changeable photo-decorative pencil torch, for example, suitable for a illumination, a great number of which are taken by numbers of people at a night meeting and turned on at the same time and then moved in the various directions, for example, vertical and/or horizontal directions to produce an optical ceremony or the like, or suitable for a toy to coax a baby or child.

For example, fire such as torch has been used for a illumination which produces an optical ceremony for a long time. However, the lightening by fire such as torch accompanies a danger of a fire. And furthermore, the illumination by fire can't be performed indoors such as a concert hall since the fire is strictly prohibited.

Then, an electric light was invented as the means for illumination. The illumination by means of an electric lamp or a fluorescent lamp is currently used. And further, an electric torch which is a portable lightening means was invented as the result of the inventin of an electric cell and has been used as the small size indoor and outdoor lightening means. A pencil torch is a kind of the electric torch and the lamp and the electric cells used are generally small and thus generally refers to a small size electric torch. The pencil torch attached with a colored cap, for example, a colored cap made of plastic or glass separatedly produced can be used not only for lightening purposes but also for signaling at night or producing an optical ceremony by turning the light on. However, with the conventional pencil torch, it is necessary to detach a colored cap from a lamp and attach another colored cap to the lamp if changing the color thereof in the state of lightening. In addition, the illuminating color of the conventional pencil torch is restricted to the one depending on the colored cap and the color of the illuminated light of the pencil torch is not ever-changing and thus is not sufficiently effective as the illuminating means for producing a ceremony.

Accordingly, it is an object of the present invention to provide a "color changeable photo-decorative pencil torch" which has interests not only as a lightening means but also as a toy, said pencil torch being small in size and suitable for carrying, said pencil torch having an illumanant, said illuminant shining beautifully at the time of being turned on, said pencil torch having scattering members, the color of light scattered at the scattering members ever-changing only by being swayed or moved, and the illumination thereof being not restricted to one direction and being scattered.

SUMMARY OF THE INVENTION

The present invention has been done to accomplish the object mentioned above, and is directed to a color changeable photo-decorative pencil torch comprising:

a transparent hollow body, said transparent hollow body having an incident part of illuminating light at a part thereof and containing light scattering liquid and a plurality of small pieces therein, each of said small pieces being substantially as same as the light scattering liquid in specific gravity and having reflecting plates on the surface thereof, and said small pieces floating in the light scattering liquid;

an illuminating light source, said illuminating light source being faced to the incident port of illuminating light of the hollow body;

a color plate, said color plate being placed at the connecting cross section of the transparent hollow body and the illuminating light source; and a color plate housing chamber, said chamber housing the color plate.

According to the present invention, when turning the light on at a floodlight portion of the illuminating light source, the illuminating light is color-changed by the color plate and introduced in the transparent hollow body and reflected by the small pieces for scattering light in the transparent hollow body and scattered by the scattering liquid without being decreased and illuminated in the transparent hollow body. Furthermore, since the small pieces for scattering light having substantially as same as the light scattering liquid in specific gravity are contained in the light scattering liquid, they are freely moved or floated in accordance with the movement of the light scattering liquid and they reflect the color-changed light in the whole direction. And furthermore, since the color plate moves with respect to the light source, the lights for illuminating the respective small pieces are momently color-changed. Thus, when swinging the color-changeable photo-decorative pencil torch while introducing the light from the floodlight portion of the illuminating light source, the light observed through the transparent hollow body shines in various colors. Therefore, when swinging numbers of the pencil torches, each of which is shaken by hands by hands in the state of turning the light on, the producing effects of the optical ceremony are greatly improved. In addition, the color changeable photo-decorative pencil torch of the present invention is suitable for a toy which arouses baby's or child's interests.

DETAILED DESCRIPTION OF THE INVENTION

Figure 1:
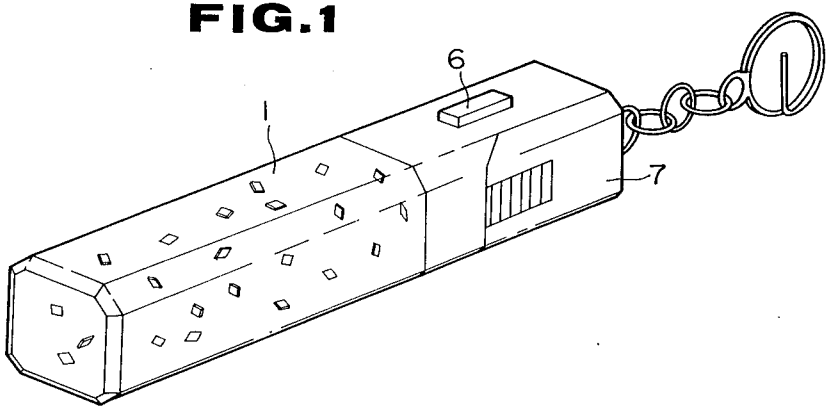
FIG. 1 is a perspective view showing the first embodiment of a color changeable photo-decorative pencil torch of the present invention.

In the present invention, the material of a transparent hollow body is not particularly restricted to any one if it only has the light scattering characteristics. The transparent hollow body might be made of a transparent plastics such as polyacrylic acid and its derivatives or a transparent glass. An uncolored or a slightly colored transparent material might be used for the production of the hollow body.

The shape or configuration of the transparent hollow body is not particularly restricted to any one if only an incident port of the illuminating light thereof is flat. The remaining part might be substantially spherical, elliptical or polygonal pole like, e.g. square pole like, hexagonal pole like, octagonal pole like, etc., in shape.

As light scattering liquid, an organic solvent, preferably the one, the specific gravity of which is greater than that of water, e.g., trichloroethylene, carbon tetrachloride, chloroform, water or a homogeneous mixture thereof might be used. For example, the commercially provided organic solvents such as Flonsolve, Trichlene might be used as the light scattering liquid in the present invention. And further, a purified water which contains a water soluble specific gravity adjusting material such as glucose, fructose, sugar or sodium chloride, an antiseptic such as citric acid or lactic acid, a surface active agent such as cationic surface active agent, e.g. trialkylbenzylammonium chloride, anionic surface active agent, e.g. sodium alkylbenzene sulfonate, soap, or ampholytic surface active agent such as higher alkyrated amino acid might be used as the light scattering liquid in the present invention.

It is preferred that the scattering liquid is charged to the extent that small gaseous phase is produced in a hollow body so that the light scattering liquid might be swayed in the hollow body when swinging or moving the hollow body.

The material of the small pieces for scattering light is not restricted to any one if it has the specific gravity substantially same with that of the light scattering liquid and has a light refractive layer on its surface. Metals and metal alloys generally have such light refractive characteristics. However, when metals and metal alloys are used by themselves, they can't float in the light scattering liquid since the specific gravities of metals and metal alloys are extraordinary greater than that of the scattering liquid used. However, a laminated sheet produced by providing or laminating a thin layer of aluminum, aluminum alloy, or the other light metal alloy on a surface of a thin layer of plastic film such as polyethylene terephthalate resin film (e.g. Tetron, the trade mark of Teijin Corporation), polyamide resin film (e.g. Nylon, the trade mark of E. I. Deupon Corporation), or epoxy resin film (e.g. polymeric compound of epychlorohydrin and Bisphenol A) and laying thereon a resin for adjusting the specific gravity thereof to the specific gravity of a scattering liquid (e.g. water of 4° C., 1 in specific gravity, organic solvent whose specific gravity is slightly greater or smaller than 1) can be used as a material of the small pieces for scattering light.

A illuminating light source might be composed of an electric cell, a chamber for housing the electric cell, a miniature electric lamp as a light source of floodlight portion, and a switch for turning the miniature electric lamp on or off. The shape of illuminating light source can be optionally changeable depending on the size of the electric cells used.

A color plate might be prepared by adhering a light transmissible red color piece, a light transmission blue color piece and a light transmission green color piece on a transparent plate in various configurations or optionally coloring a surface of a transparent film plate with a light transmissible red color paint, a light transmissible blue color paint and a light transmissible green color paint. The shape of the color plate is not particularly restricted to any one. However, it is preferred that the color plate might be thin and disk like in its configuration so that it can move or sway in a color plate housing chamber.

Now several particular embodiments of a color changeable photo-decorative pencil torch of the present invention will be explained with reference to the attached drawings.

Figure 2:
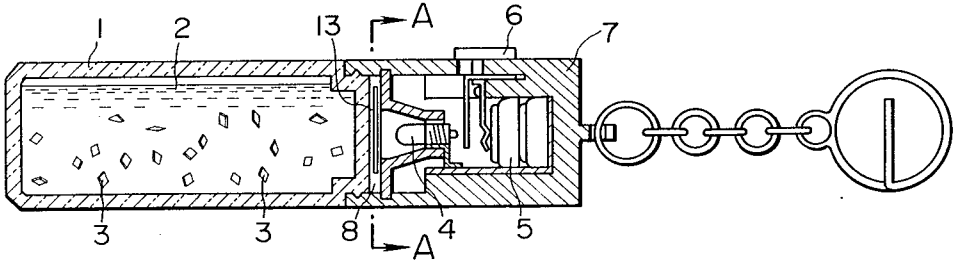
FIG. 2 is a longitudinal sectional view illustrating the construction of the pencil torch shown in FIG. 1.
Figure 4:
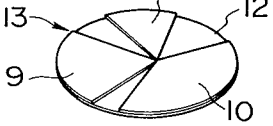
FIG. 4 is a schematic view illustrating a constitution of the color plate which is an element of the color changeable photo-decorative pencil torch shown in FIGS. 1 and 2.
Figure 3:
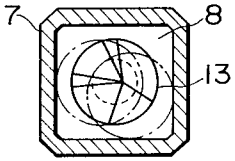
FIG. 3 is a schematic view illustrating the movement of a color plate in a color plate housing chamber of the color changeable photo-decorative pencil torch shown in FIG. 2.

FIGS. 1 and 2 illustrate the first embodiment of a color changeable photo-decorative pencil torch of the present invention and reference numeral 1 designates a transparent hollow body made of uncolored or slightly colored plastic (e.g. polyacrylic acid ester), or glass. The hollow body 1 is produced by charging light scattering liquid 2 in a transparent vessel which has a flat surface at the bottom portion, floating a plurality of small pieces for scattering light 3 in the light scattering liquid 2 and sealing an inlet for charging the light scattering liquid 2 by fusion. Apart from the hollow body 1, an illumination light source 7 which contains an electric cell 5 and comprises a miniature electric lamp 4 and a switch 6 for turning the miniature electric lamp 4 on or off is prepared. The thus-produced illuminating light source 7 is connected detachable freely to the flat surface of the hollow body 1 which transmits the light of the electric lamp 4 upon turning the light on so as to form a color plate housing chamber 8 in a space defined by the miniature electric lamp 4 and a flat surface 13 of the hollow body 1. When assembling a pencil torch, a disk like color plate 13 made by adhering a transparent red color film 9, a transparent blue film 10 and a transparent green film 11 on a transparent film as shown in FIG. 4 is inserted in a color plate housing chamber 8. When moving or swinging the thus constructed color changeable photo-decorative pencil torch, the color plate 13 moves or sways freely in the housing chamber 8 as shown in FIG. 3 and scattering of the light occurs in the hollow body 1.

Incidentally, an electric cell 5 might be put in and out the housing cell by providing a freely openable inlet for an electric cell replacement or designing the miniature electric lamp 4 detachable free so that the electric cell 5 is taken out after the miniature lamp 4 is taken off.

Figure 5:
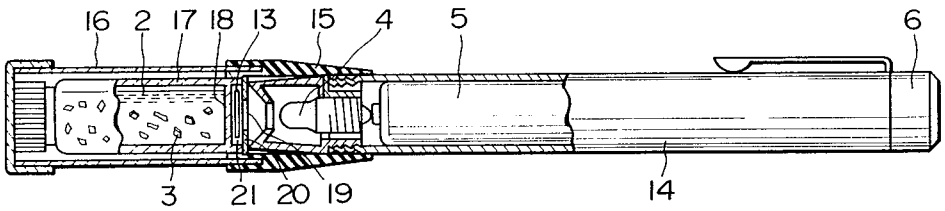
FIG. 5 is a sectional view showing the second embodiment of a color changeable photo-decorative pencil torch of the present invention.

FIG. 5 illustrates the second embodiment of a color changeable color-decorative pencil torch of the present invention.

The main feature of this embodiment exists in a point that the commercially provided pencil torch 14 which uses two UM-3 electric cells is used for the illuminating light source. In this embodiment, a transparent cover pipe 16 containing a housing chamber 21 for containing a color plate 13 and a transparent hollow body 12 connected thereto via a flat surface 18 are connected to the top of the commerically provided pencil torch 14 by means of a rubber cap 15. In this embodiment shown in FIG. 5, a transparent hollow body 17 is shaped like a bottle, in which light scattering liquid 2 and a plurality of small pieces for scattering light 3 are sealed, and the bottom edge of the transparent cover pipe 16 can be connected to the rubber cap 15. At the space defined by the flat surface 18 of the bottom of the transparent hollow body 17 and the inner bottom portion 20 with a light passing hole 19 of the rubber cap 15, the chamber 21 for housing the color plate 13 is provided, and the color plate 13 freely sways or moves in the chamber 8. The electric cells can be replaced by pulling the pencil torch 14 out of the rubber cap 15 and removing the miniature lamp 4 of the pencil torch 14.

Figure 6:
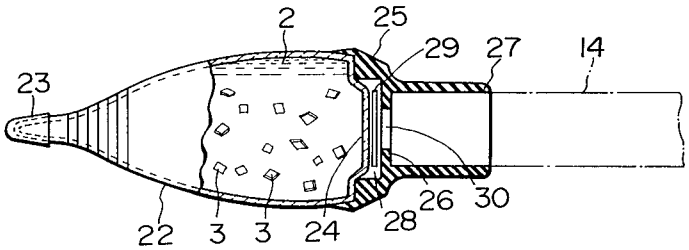
FIG. 6 is a a sectional view showing the third embodiment of a color changeable photo-decorative pencil torch of the present invention.

FIG. 6 illustrates the third embodiment of a color changeable photo-decorative pencil torch of the present invention. A transparent hollow body 22 is cone-shaped like a candle flame. The transparent hollow body 22 is prepared by charging light scattering liquid 2 and a plurality of small pieces 3 for scattering light, sealing it by fusion and mounting an elastic protection cap 23 at the sealed portion. At the bottom surface 24 of the conical hollow body 22, a connecting rib 25 shaped to fit the bottom portion of the hollow body 22 and a rubber cap 27 having an central inner bottom portion 26 thereof are adhered by an adhesive, and a chamber 28 for housing a color plate is provided at the space defined by the flat surface 24 of the bottom portion of the hollow body and the inner bottom portion 26 of the rubber cap so that it can move or sway freely in the chamber 28.

Figure 7:
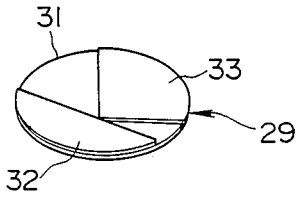
FIG. 7 is a view showing another construction of a color plate which is an element of a color changeable photodecorative pencil torch according to the present invention.

At the center of the inner bottom portion of the rubber cap 27, a light-passing hole 30 is provided, which transmits the illuminating light irradiated from the pencil torch 14 inside so that the illuminating light reaches the hollow body through a color plate 29. The color plate 29 used is prepared by adhering a red color film piece 32 and a blue color film piece on a transparent base sheet 31 as shown in FIG. 7. Instead of adhering these color films on a transparent disk, the color plate can be produced by coloring the transparent base sheet with transparent red and blue color paints.

Figure 8:
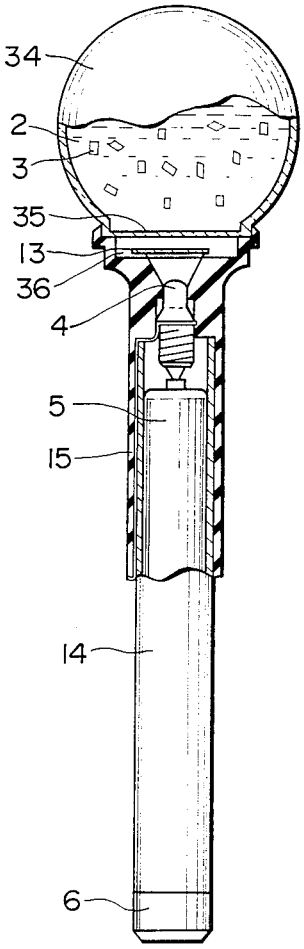
FIG. 8 is a sectional view illustrating the fourth embodiment of a color changeable photo-decorative pencil torch of the present invention.

The fourth embodiment of a color changeable photodecorative pencil torch of the present invention will be explaiend with reference to FIG. 8. The difference between the fourth embodiment shown in FIG. 8 and the second embodiment shown in FIG. 5 exists in a point that in the fourth embodiment, the miniature electric lamp 4 is not mounted in a freely detachable manner onto the top of a cylindrical portion 14 which houses two UM-2 electric cells. In the second embodiment, the miniature electric lamp 4, which is a light source, is mounted at the top of the pencil torch in a detachable manner. Whereas in the fourth embodiment, a chamber 36 for housing a color plate 13 and a miniature electric bulb 4, which is the light source of the light transmitted through the color plate 13, are provided in a rubber cap 15, which supports a quasi-spherical transparent hollow body 34 having a flat surface 34, so that when the cylinder for housing the electric cells 5 is inserted into the rubber cap 15, the anode of the housed electric cells 5 is brought into contact with the bottom of the miniature electric lamp 4 in the rubber cap 15 and then the miniature electric lamp 4 is turned on or off in accordance with the movement of the switch 6. Therefore, in the fourth embodiment, a color plate 13 moves or sways in the housing chamber 36 in accordance with the movement of swing of the pencil torch in the vertical or horizontal direction while turning the light on. The illuminating light is color-changed by the color plate 13 and introduced in the hollow body 34 and reflected by the small pieces for scattering light in the hollow body and scattered by the light scattering liquid 2. Accordingly, the light observed shines in various colors ever-changingly.

EXAMPLE

The small pieces for scattering light and the light scattering liquid were prepared as follows:

(PREPARATION OF SMALL PIECES FOR SCATTERING LIGHT)

Figure 9:
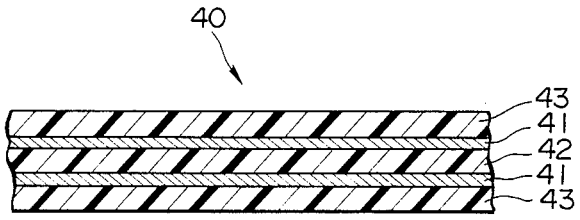
FIG. 9 is a schematic view explaining a method for producing a small piece for scattering light which is an element of a color changeable photo-decorative pencil torch of the present invention.

As shown in FIG. 9, biaxially oriented polypropylene layer was laminated by aluminum deposition technique so as to be a thickness of 0.025 mm on both surfaces of a Tetron film of specific gravity of 1.4 and thickness of 0.012 mm. The thickness of the deposited aluminum 42 was 0.05 micrometer and the thus-prepared laminated sheet 43 has a specific gravity of approximately 0.93. The laminated sheet was cut into small pieces 2 of approximately 2 to 3 mm×2 to 3 mm in size.

(PREPARATION OF LIGHT SCATTERING LIQUID)

Light scattering liquid was prepared by adding 2 kg of glucose, 5 g of citric acid and 0.1 g of sodium trialkylbenzene sulfonate to 22 liter of purified water. The surface tension of the small pieces was removed by the addition of the surface active agent which improves the scattering efficiencies of the small pieces. The thus prepared liquid is harmless to the human body even if it is swallowed by accident.

Figure 10:
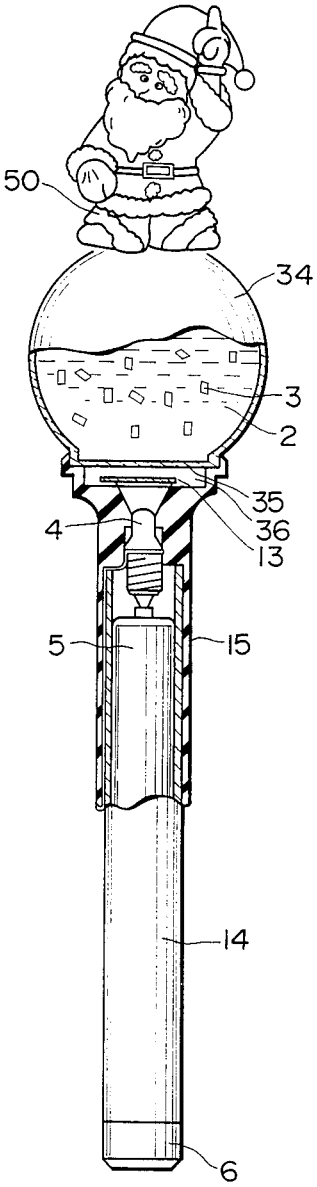
FIG. 10 is a view illustrating a modified embodiment of a color changeable photo-decorative pencil torch of the present invention which attracts a baby's or child's interests as a toy by providing a mascot on a top of a transparent hollow body, said transparent hollow body being an element of the color changeable photo-decorative pencil torch of the present invention.

The above description is based on the specific embodiments, but the present invention is not restricted to these embodiments. The composition of light scattering liquid can be changed if necessary depending on the specific gravity of the small pieces for scattering light, and the shape of the transparent hollow body can be also changeable if necessary. For example, as shown in FIG. 10, if a mascot 50 such as a animal, a character of a story etc., is mounted onto the top of the transparent hollow body, it can provide a pencil torch which is attractive as a toy.

What is claimed is:

1. A color changeable photo-decorative pencil torch comprising:

a transparent hollow body, said transparent hollow body having an incident port of illuminating light at a part thereof and containing light scattering liquid and a plurality of small pieces therein, each of said small pieces being substantially as same as the light scattering liquid in specific gravity and having reflecting plates on the surface thereof, and said small pieces floating in the light scattering liquid;

an illuminating light source, said illuminating light source being faced to the incident port of illuminating light of the hollow body;

a color plate, said color plate being placed at the connecting cross section of the transparent hollow body and the illuminating light source; and a color plate housing chamber, said chamber housing the color plate.

2. A color changeable photo-decorative pencil torch according to claim 1, wherein said transparent hollow body is made of an uncolored or slightly colored transparent plastic or glass.

3. A color changeable photo-decorative pencil torch according to claim 2, wherein said light scattering liquid is an aqueous solution containing approximately 0.091 parts by weight of glucose, approximately $2.27\times10^{-4}$ parts by weight of citric acid and approximately $4.5\times10^{-6}$ parts by weight of a surface active agent per 100 parts by weight of purified water, and each of said small pieces is approximately 0.93 in specific gravity.

4. A color changeable photo-decorative pencil torch according to claim 3, wherein each of said small pieces is the one prepared by laminating a biaxially oriented polypropylene layer of 0.95 in specific gravity on both surfaces of Tetron film 1.4 in specific gravity and 0.012 mm in thickness via deposited aluminum layer of 0.025 mm in thickness and cutting the laminated sheet into approximately 2 to 3 mm×2 to 3 mm in size.

5. A color changeable photo-decorative pencil torch according to claim 1, wherein said light scattering liquid is an aqueous solution containing approximately 0.091 parts by weight of glucose, approximately $2.27\times10^{-4}$ parts by weight of citric acid and approximately $4.5\times10^{-6}$ parts by weight of a surface active agent per 100 parts by weight of purified water, and each of said small pieces is approximately 0.93 in specific gravity.

6. A color changeable photo-decorative pencil torch according to claim 1, wherein each of said small pieces is the one prepared by laminating a biaxially oriented polypropylene layer of 0.95 in specific gravity on surfaces of Tetron film 1.4 in specific gravity and 0.012 m in thickness via deposited aluminum layer of 0.025 mm in thickness and cutting the laminated sheet into approximately 2 to 3 mm×2 to 3 mm in size.

* * * * *